US005908286A

United States Patent [19]

Clemmons

[11] Patent Number: 5,908,286

[45] Date of Patent: Jun. 1, 1999

[54] MOTOR DRIVEN FUEL PUMP AND CONTROL SYSTEM FOR INTERNAL COMBUSTION ENGINES

[75] Inventor: Robert T. Clemmons, Fairfield, Ill.

[73] Assignee: UIS, Inc., New York, N.Y.

[21] Appl. No.: 08/444,413

[22] Filed: May 19, 1995

[51] Int. Cl.[6] ..... F04B 49/06; F04B 35/04

[52] U.S. Cl. ..... 417/44.2; 417/44.9; 417/53; 417/357; 417/366; 417/410.4

[58] Field of Search ..... 417/44.7, 44.9, 417/53, 357, 366, 410.4, 434

[56] References Cited

U.S. PATENT DOCUMENTS

| | | | |
|---|---|---|---|
| 3,711,222 | 1/1973 | Hartley | 417/44.9 |
| 4,756,291 | 7/1988 | Cummins et al. | 123/497 |
| 4,756,669 | 7/1988 | Hata | 417/44.2 |
| 4,775,917 | 10/1988 | Eichhorn et al. | 361/388 |
| 4,926,829 | 5/1990 | Tuckey | 123/497 |
| 5,006,048 | 4/1991 | Jow | 417/366 |
| 5,055,758 | 10/1991 | Hock | 318/645 |
| 5,593,287 | 1/1997 | Sadakata et al. | 417/366 |

OTHER PUBLICATIONS

Motorola Linear/Interface Devices, Specifications and Applications Information, no date available.

*Primary Examiner*—Charles G. Freay
*Attorney, Agent, or Firm*—Andrus, Sceales, Starke & Sawall

[57] ABSTRACT

An in-tank motor-pump unit includes a motor driven gear pump, a pressure transducer, and a control module as a single integrated package establishing fuel flow at a constant pressure by creating a pulse-modulated motor drive having a fixed "off" and a variable "on" period. A permanent magnet DC motor drives a rotary pump with the required torque operating over the specified speed range and without stalling out at low flow demand. An integrated circuit board includes an IC timing chip, operating in an astable mode, has an input connected to the transducer and an output connected to a MOSFET switch which connects the motor to a power supply. A series resistor connects an amplified voltage signal of the transducer to charge the capacitor and discharge resistor separately connects the capacitor to the input of the timing chip to generate a constant "off" period and a variable operative "on" period of the MOSFET. A slight recycle fuel flow is established with substantially equal "on" and "off" periods at substantially zero fuel flow.

26 Claims, 8 Drawing Sheets

MOTOR DRIVEN FUEL PUMP AND CONTROL SYSTEM FOR INTERNAL COMBUSTION ENGINES

BACKGROUND OF THE INVENTION

This invention relates to a motor driven fuel pump and control system for internal combustion engines, and particularly to an apparatus and method which continuously monitors the fuel system pressure and regulates the fuel flow to a predetermined pressure, and controls the flow of fuel at an essentially constant pressure from a remote fuel tank to the engine.

Fuel delivery systems for modern internal combustion engines, particularly engines using fuel injection, generally use a motor driven fuel pump. A fuel pump operated at an appropriate manner provides for a more precise flow of fuel for injection into the engine. The fuel pump may be mounted external to or within the fuel tank. The connection may use either a single line direct flow or a constant flow with excess fuel redirected to the fuel tank via a return line. For various reasons, direct line connection without a need for the return line, is desirable.

Various prior art patents disclose the various fuel systems. For example, U.S. Pat. No. 4,756,291, which issued Jul. 12, 1988 to Cummins et al and is assigned to the Ford Motor Company, discloses a control system for a motor driven fuel pump in which a control system is provided having a high voltage limit and low voltage limit related to the flow pressure. If the flow related voltage signal rises above the high voltage limit or below the low voltage limit, the control system adjusts the motor drive, using a pulse width modulated signal. U.S. Pat. No. 5,055,758 which issued Oct. 8, 1991 to Hock is assigned to Jabil Circuit Company, discloses a motor driven fuel pump establishing an alternating current signal in combination with a voltage control signal related to the flow, which is superimposed on the alternating signal. An output drive signal is a pulse, the width of which is set by the intersecting of alternating current signal by the flow related voltage control signal. This again provides a pulse width modulated signal, which is varied each half cycle of the main supply signal.

The more recent patent to Hock '758 discloses the motor pump unit mounted within the fuel tank proper, while the earlier Cummins et al '291 patent discloses the motor and pump mounted external to the fuel tank. Generally, each prior art system can use a motor driven pump in it mounted within or external to the fuel tank, Other patents of general interest are, of course, disclosed in the above two patents.

The fuel delivery systems are required to provide fuel in relatively precise amounts to the engine and in appropriate time relation. Maintaining of a proper flow and pressure has presented various problems with respect to providing a cost effective supply system. Sensing units must be able to accurately determine the pressure characteristic. The system must be of a relatively small and compact construction while able to handle the power to drive the pump motor and a control system, and the system must have a long operating life preferably corresponding substantially to the life of an engine. Although a life of 50,000 miles of operation is generally considered a good life, a more satisfactory anticipated need is between 100,000 and 200,000 miles. The power consumption should be minimal while the motor operates under sufficient power and torque to maintain the desired flow under pressure over the total engine speed range. A smooth flow at a relatively constant pressure from the fuel tank to the engine is desirable to maintain an efficient system, with minimal fuel consumption. Further, the system must operate in the various environments encountered by engines, such as in automobiles, and preferably over the life of the engine.

The requirements for an improved fuel delivery system having the optimal characteristics thus present various considerations and demands with respect to cost, life and size. There is a present need for a compact, cost effective fuel pump unit, which can supply fuel at an essentially constant pressure at the engine without requiring significant maintenance and/or replacement during the normal life of the vehicle marine and other internal combustion engines.

SUMMARY OF THE PRESENT INVENTION

The present invention is particularly directed to a fuel pump system providing a fuel supply under a constant pressure, and with the total assembly particularly adapted for mounting within a fuel tank. In one aspect of the present invention, an integrated assembly consisting of the motor driven pump, a sensor unit and a control module are formed as a single integrated package adapted for in-tank fuel mounting. The system is adapted to establish a desired constant pressure over the operating range of the engine, and with the particular pressure conforming to existing practical requirements of a constant pressure presently within the range of 18–65 PSI±2 PSI, as well as others which may be required. Generally, in accordance with the above aspect of the present invention, a pump is secured to one end of a motor with a control module secured abutting the motor in heat exchange relation. A transducer is mounted within the control unit to the pump outlet side of the motor driven pump, coupled to the outlet and establishes a control signal essentially directly corresponding to and related to the output pressure level of the pump unit.

The motor, in a preferred system, is one which would have improved torque over the speed range necessary to provide the desired output flow without stalling during low flow conditions. The present invention uses a DC permanent magnet motor which has been especially designed to provide this characteristic. A rotary pump is coupled to the motor output shaft and is directly driven with the energized motor. The control circuit establishes the necessary motor response to control the pump speed to maintain the essentially constant desired output pressure.

In the preferred construction for in-tank mounting, the output of the pump includes an output port and a bleed port of a relatively minimal size, to establish an exit for vapor with a continuous flow so as to prevent pump cavitation or system vapor lock, even when no or little fuel is being withdrawn from the unit. The control unit is sealed and is adapted to be mounted within the fuel tank. In the present invention, a control circuit is provided to establish a control energizing signal to the motor, at which level the motor operates to establish a constant desired output pressure. The system is driven from a source establishing an on-off drive state, using a preferred pulse drive control system. If the pressure rises above such level, the preferred pulse drive control system responds to the related transducer signal to reduce the motor "on" pulse width signal thereby reducing the motor speed until the pressure signal drops to the desired level. If the pressure falls below the desired output level, the control system responds to the related transducer signal to increase the motor "on" pulse width signal thereby increasing the motor speed until the pressure signal reaches the desired output level. The control system module preferably includes an outer control housing within which a suitable solid state control unit is mounted. The control housing is secured to the motor unit. The transducer unit is mounted within the housing in operative coupling to the outlet port unit of the motor-pump unit. Although a transducer which can operate in the fuel supply environment may be used, a transducer including a silicon piezoresistive pressure sensor provides a highly accurate and linear voltage output directly proportional to the applied pressure. The transducer is connected to the control circuit and provides an output voltage in accordance with the output pressure from the pump unit. The control housing is secured to the motor housing preferably with a complementing portion bonded with adhesive to form a suitable heat transfer mechanism and with a mechanical interconnection to firmly secure the control unit in place. A control circuit board is mounted within the housing and consists of an appropriate solid state circuit.

An integrated circuit board and lead frame provides a convenient input/output connection unit for interconnecting of the control unit into a total operating system. The total operating system, including the control system, should not create hot spots and particularly such as to damage the solid state components, as well as minimize boiling and vaporization of the gasoline.

In a preferred system, an IC amplifier or amplifiers and an IC motor drive unit is adapted to give a substantially constant output pressure for any particular required flow condition by using no modulation, or alternatively a special pulse width modulated signal. Thus, for any given flow condition the motor speed is varied to maintain the constant output pressure desired. The output of the control circuit includes a solid state switch unit connected between the input to the motor and the DC power supplied to the motor. A low power transistor switch such as a MOSFET transistor, is preferably used. In the preferred construction, a resistor connects the pressure responsive signal to charge a capacitor thereby controlling the pulse width "on" time. The capacitor is discharged through another resistor and discharge transistor inside an IC timing chip to control the "off" pulse width. The output of the timing chip has a substantially constant "off" period and a variable operative "on" period connected to the switch unit connecting the input of the motor to a D.C. supply. When the desired operating pressure is reached. The timing chip generates a square wave frequency signal to the switch unit having an essentially equal "on" and "off" periods with the fuel pump motor maintaining the desired pressure, when the fuel flow rate is zero or at very low flow rates during engine idle conditions. Thus the "on" period varies with the pressure responsive signal to extend the operative "on" period continually over the flow range needed by the engine while maintaining the same operative "off" period. The circuit board is preferably direct bonded to the motor housing, which serves as a heat sink with the control housing encircling the unit, and interconnected to the motor housing and to the output port coupling. The housing of the motor body then becomes a total heat sink for the circuit components and particularly the transistor switch in the control circuit. Although preferably constructed as a total integrated unit, separate components can, of course, be constructed and mounted separately. Again, the control circuitry and the electrical interconnection must be appropriately constructed to avoid hot spots, leakage, and the like.

The motor driven fuel system as disclosed herein has been particularly designed for in-tank mounting of the motor driven fuel pump and the control module, but can be readily applied to an external mounting, with or without the conventional return line.

The present invention thus provides an improved fuel supply system which can, particularly in its optimal construction, be conveniently in-tank mounted, establish and maintain a constant pressure to the engine, and thereby assure appropriate flow of fuel from the tank to the engine with proper fuel injection.

BRIEF DESCRIPTION OF THE DRAWINGS

The drawings furnished herewith illustrate a preferred construction of the present invention in which the above advantages and features are clearly disclosed as well as others which will be readily understood from the following description of the illustration embodiment. In the drawings.

DESCRIPTION OF THE ILLUSTRATED EMBODIMENTS

Figure 1:
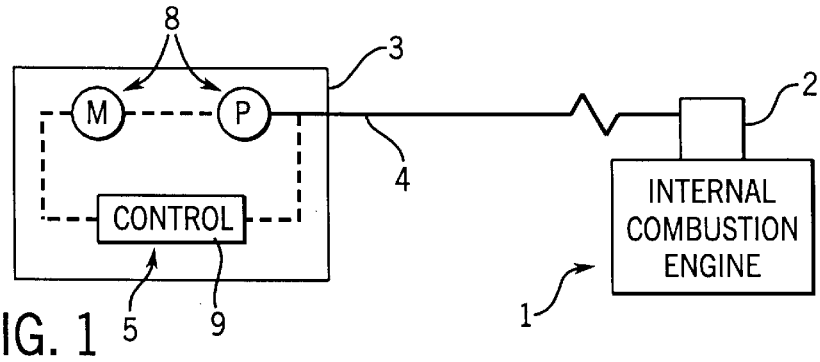
FIG. 1 is a diagrammatic illustration of an internal combustion engine with a fuel supply system incorporating an in-tank fuel pump unit constructed to illustrate an embodiment of the present invention.

Referring to the drawing, and particularly to FIG. 1, a diagrammatic illustration of a internal combustion engine 1 includes an engine fuel supply input unit 2, such as a carburetor or fuel injection unit. Fuel tank 3 is shown connected by a fuel line 4 to the engine mounted supply unit 2. An electrically operated fuel pump assembly 5 is illustrated mounted within the fuel tank 3. Fuel pump assembly 5 includes an input unit 6 for withdrawing of fuel 6*a* from within the tank 3 and an output line or pipe 7 for connecting the output of the fuel assembly 5 to the fuel line 4. The fuel pump assembly 5 is operable in synchronous with the operation of the engine 1 to continuously supply fuel 6*a* to the engine at a constant pressure, which produces the necessary flow of fuel to the engine for smooth operation.

Figure 2:
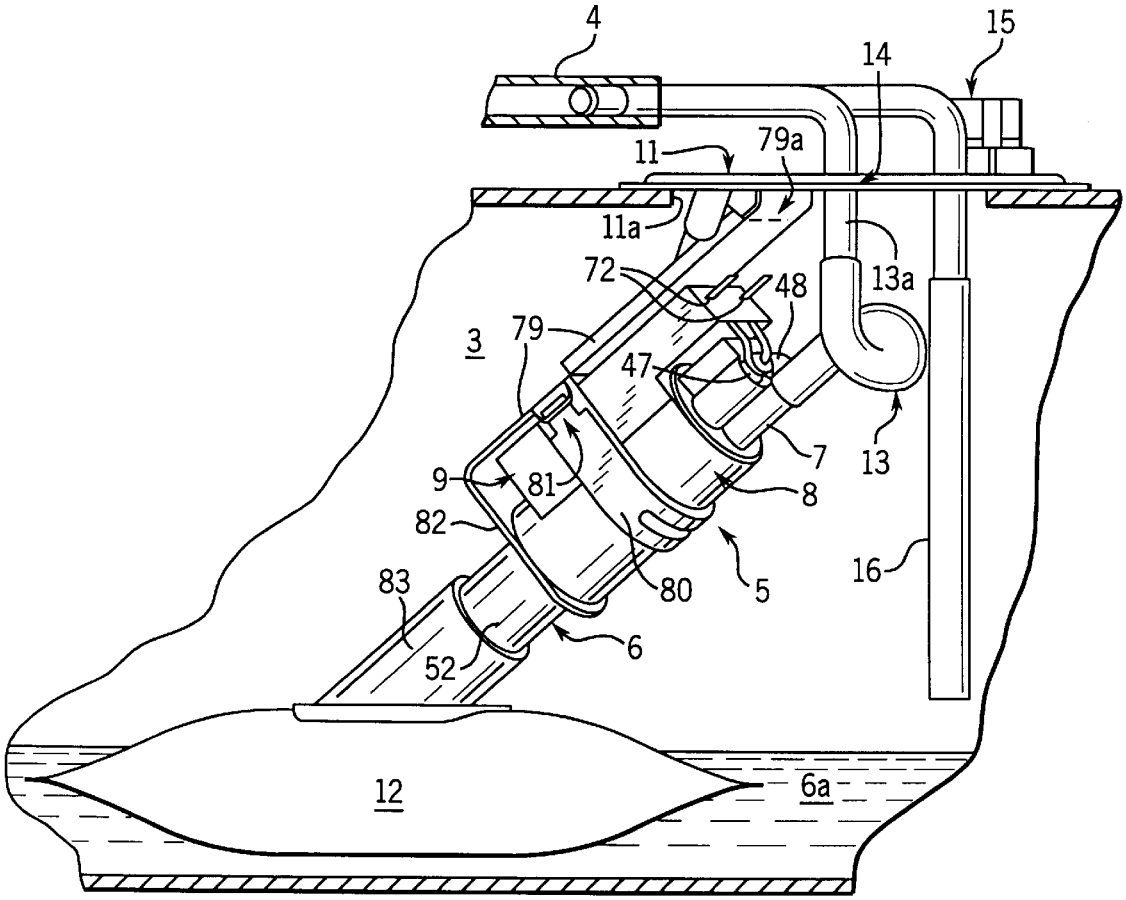
FIG. 2 is an enlarged, separate view of the integrated fuel pump unit illustrated in FIG. 1.
Figure 7:
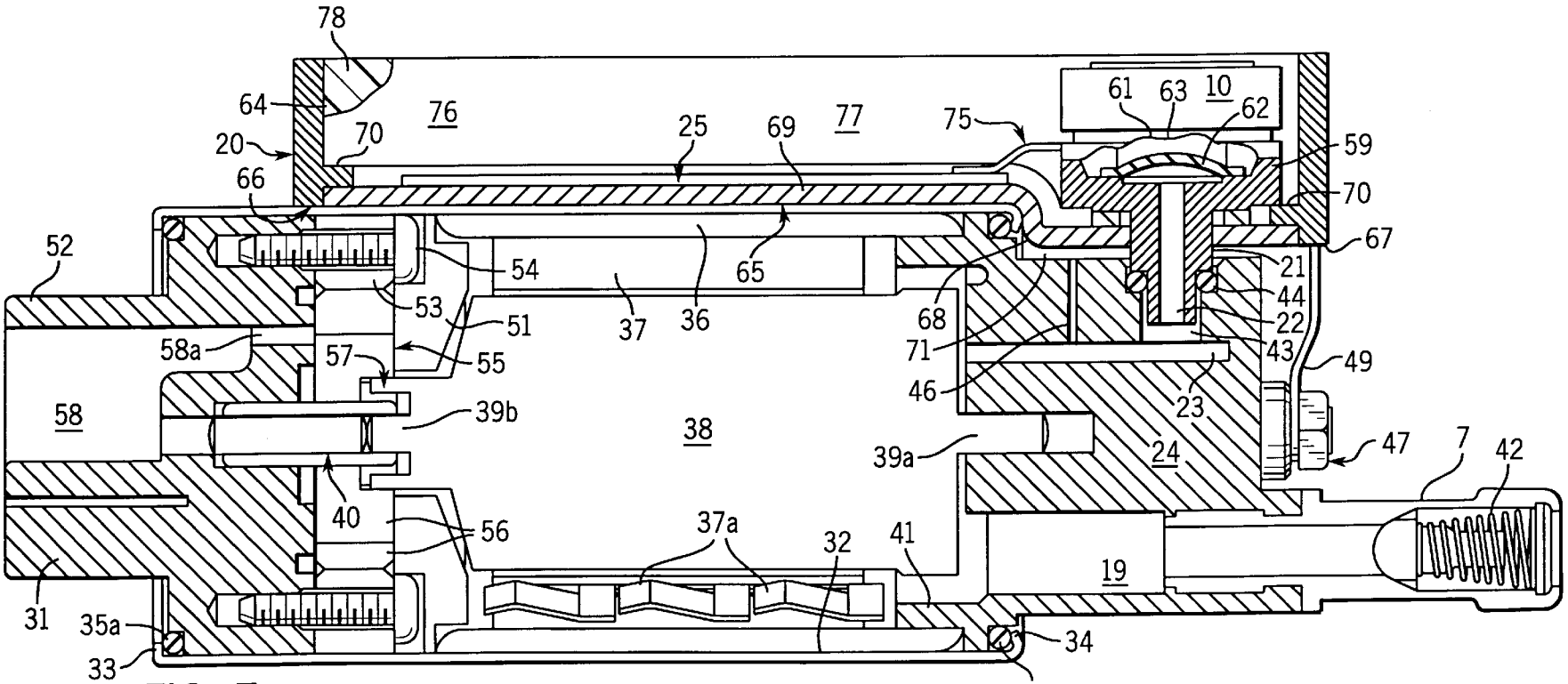
FIG. 7 is an enlarged vertical section taken generally on line 7—7 of FIG. 6.

Referring to FIGS. 1 and 2, the fuel pump assembly 5 includes a motor-pump unit 8 connected to the input unit 6 and the output line or pipe 7. A motor control unit 9 is secured to the unit 8 and establishes an integrated assembly. Thus, the motor control unit 9, as hereinafter more fully described and shown in FIG. 7, is an electronic control including a pressure transducer 10 for interconnecting of a power supply to the motor-pump unit 8 to maintain a constant output pressure at the engine mounted supply unit 2. The electric fuel pump assembly 5 is mounted within the tank 3 in any suitable manner. As shown in FIG. 2, the illustrated embodiment for the in-tank mounting includes a generally circular mounting plate 11, adapted to be secured in overlying relation to a top wall opening 11*a* in the top wall of the tank 3. The fuel inlet unit 6 is coupled to a bottom filter assembly or unit 12, located immediately adjacent to the bottom wall of the tank. A coupling unit 13 interconnects the pump outlet pipe 7 to the line 4. Thus, the coupling unit 13 includes a pipe 13*a* extending upward through a sealed opening 14 in the plate 11, with a releasable pressure sealed joint between the outer end of the coupling line 13*a* and line 4. An electrical input power connector 15 is secured to the plate 11 and provides for input power connection to the control unit 9 and motor-pump assembly 5, as more fully described herein after.

Referring particularly to FIGS. 2–7, the motor-pump assembly 5 includes an electric motor 17, preferably a high torque motor of a permanent magnet type with present day technology. The illustrated motor 17 is a flow through motor with the fuel flowing through the motor chamber between the fuel inlet and outlet. A gerotor pump unit 55 is secured to the inlet end of the motor-pump assembly 5 with an outlet passageway 19 receives the connecting fitting 7 to supply fuel to the coupling line 13 and line 4 upon operation of the motor 17. The operation of the motor 17, in the illustrated embodiment of the invention, is controlled by the control unit 9, which is shown secured in integrated abutting relation to the motor 17.

Figure 10:
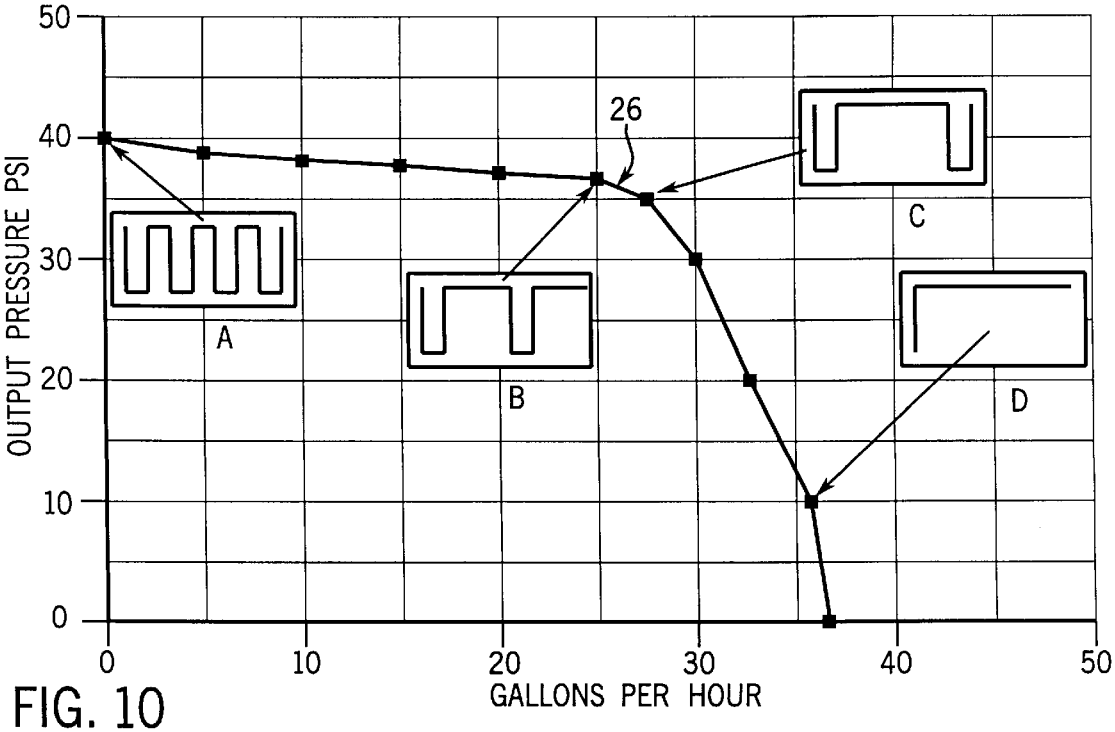
FIG. 10 is a diagrammatic illustration of the characteristic pressure versus drive output of the circuit of FIG. 8.

The control unit 9 includes an outer housing 20, with the pressure transducer 10 mounted in one end thereof and in overlying relation to the output end of the motor 17. The transducer 10 has a pressure input port 21 connected to the outlet end of the motor 17. Port 21 has a pressure sensing passageway 22 coupled to a passageway 23 in the motor end frame 24. Passageway 23 connects the flow through passageway of motor 17 and provides an output pressure signal in accordance with the output pressure established by the motor within the flow through passageway, and thereby the outlet passageway 19. The output of the pressure transducer 10 is connected to a control circuit board 25 mounted within housing 20. The output of the circuit on board 25 is connected to control the speed of the motor 17 and thereby the output pressure established in line 4. In accordance with the preferred construction and operation of the system, the input to motor 17 and the output pressure characteristics are related to each other as shown in FIG. 10. In particular, the motor pulse width characteristics vary with the demand and includes a constant "off" period and variable "on" period to produce a selected pressure and flow. A typical performance is shown in FIG. 10 at operating points 10*a*, 10*b*, 10 *c*, and 10*d*. With the output pressure below the desired operating pressure, the power to the electric motor 17 is at a constant voltage level as at operating point 10*d*. As the pressure rises to the desired operating point the motor 17 is energized as shown at operating point 10*c*. As the pressure reaches point 10*b* the pulse width modulated frequency begins increasing and continues to increase until low or zero flow point 10*a* is reached. The pulse width modulated signal is continually varied between points 10*a* and 10*b* to supply fuel on demand as required by the engine. The only motor operation necessary as shown at point 10*a* when the supply pressure is above the desired level is to maintain slight circulation of fuel through the motor and through an internal bypass system within the fuel tank as hereinafter described. The fuel supply system thus provides an essentially continuous and constant output operation of motor 17 supplying fuel as demanded while maintaining the desired pressure level, by using the variable "on" pulse width modulated drive signal to energize motor 17.

Figure 7A:
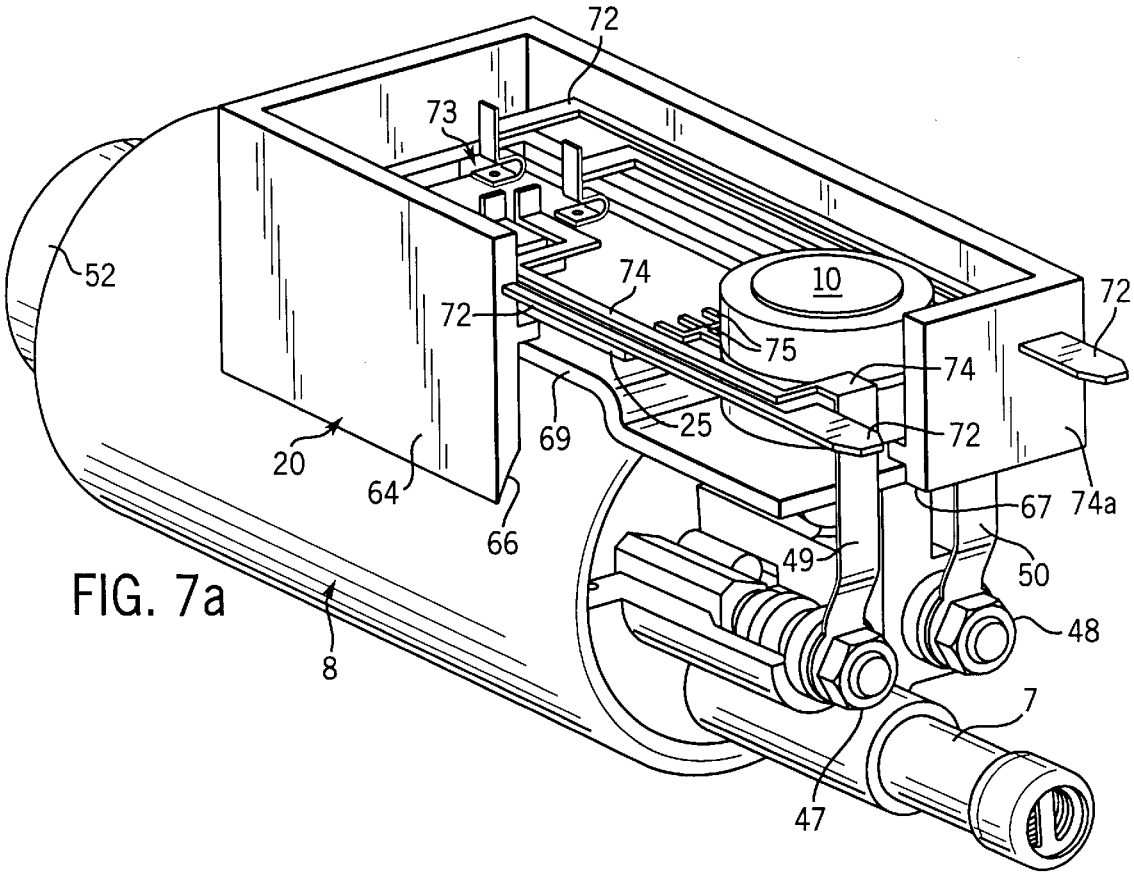
FIG. 7*a* is a pictorial view assembly with the circuit board removed to more clearly illustrate power and motor connectors.

Thus, the present invention is particularly directed to an integrated motor control assembly 5 as an improved assembly for an in-tank mounting of a fuel supply system, but may be used in an externally mounted system. The invention is further directed to a unique control system and circuit for establishing the preferred motor drive characteristics as shown in FIG. 10. More particularly, in the illustrated embodiment of the preferred construction of the assembly in accordance with the first aspect of the invention, the motor-pump unit or assembly 8 has the motor 17 and pump unit 55 secured in end to end relation between the inlet unit 6, the inner portion of which forms an end frame 31, and the motor end frame 24 as shown most clearly in FIGS. 7 and 7*a*. An outer tubular shell 32 is secured in place by the ends turned inwardly in clamping relation, as at 33 and 34, over opposite end frames 31 and 24, respectively. O-ring seals 35 and 35*a* are disposed between the shell end turns and the end frames 31 and 24 to seal to each other, and define the flow through system, with the fuel passing over and through the motor components between the end frames 31 and 24. Thus, the motor has an outer tubular motor frame 36 including permanent magnets 37 and magnet separating spacer 37*a*. A rotor 38 is mounted within the motor frame 36 with a rotor shaft 39. The one end 39*a* of the shaft is mounted in end frame 24. The opposite end 39*b* of the rotor shaft is mounted within a bearing 40 and supported within the opposite end frame 31 and coupled to the gear pump unit 55. The motor end frame 24 is shown as a solid plastic body member having an annular flange 41, projecting inwardly within the shell 32 between the o-ring seal 35 and the motor frame 24. The frame includes the outlet passageway 19 in the fitting or pipe 7 secured in sealed relationship therein and projecting outwardly from the end frame 24 in parallel relation to the motor axis. A spring loaded one way check valve 42 is located within the outer end of the pipe 7, and permits flow of gasoline from the motor-pump unit 8 to the coupling 13, 13*a* and line 4 to the engine 2, as shown in FIG. 2. The pressure sensing passageway 23 is formed within the plastic end frame 24, and extends from the motor chamber parallel to the motor axis, terminating in a laterally and perpendicularly related enlarged sensing passageway 43. The pressure sensing port 21 of the pressure transducer 10 is sealed within the outer end of passageway 43 with an o-ring seal 44, preventing leakage from the sensing passageway. The o-ring seal 44 is located within a stepped portion of the port 21 and the passageway 43.

In addition, a small circulating passageway 46 is connected to the passageway 23, shown in parallel relationship to the opening 43, and terminates in the surface of the end frame 24. Passageway 46 provides for circulation of fuel 6*a* within the tank 3 under all operating conditions to maintain a constant flow of liquid through the motor-pump unit 8 and helps prevent pump cavitation and system vapor lock conditions. The passageway 46 is located within the frame at a high exit position with respect to the motor-pump unit 8 to insure continuous purging of fuel vapors. The sensing structure insures accurate sensing of the pressure condition, and rapid actuation of the system to maintain the constant pressure desired. The outer face of the end frame 24 includes the motor power terminals 47 and 48, which are connected to the motor winding through any suitable connection in accordance with known construction. The illustrated motor terminals are conventional threaded units, with interconnecting conductive straps 49 and 50, connecting the terminals to motor power supply terminals of the control unit 9. Power to the motor 17 actuates the pump unit 55 and establishes a flow from the inlet end of the motor pump assembly 5 to the fitting 7 and thereby via coupling 13 to line 4.

The gerotor pump unit 55 of unit 8 is secured in place by a connection between the interface of the end frame 31 and a motor end frame 51 which is located between gerotor pump unit 55 and the inner end of the motor frame 31. The end frame 31 has the annular body portion secured within the shell 32 and the axial outward projecting portion 52 forming a part of inlet 6 for connection to the inlet screen unit 12. The gerotor unit pump unit 55 is illustrated in a preferred construction as a positive displacement gerotor pump, including an outer fixed annular member 53, defining an inner pump chamber. The member 53 is secured in abutting relation to the inner flat face of the end frame 31 by suitable clamping bolts 54. A rotating gerotor 56 is mounted on bearing 40 within the end frame 31, with the driven gerotor 56 in operative sliding engagement within the gear member 53. The gerotor 56 and the adjacent end of the rotor including the rotor shaft 39*b*, is provided with a releasable drive 57. Operation of the motor 17 results in rotation of the gerotor pump unit 55 and pumping of fuel through inlet unit 6 and through the motor. The inlet unit 6 is formed with the extension 52 of the frame 31 and is provided with an enlarged end opening 58 and coupling passageway opening 58*a* to the interface of the end frame 31 and the pump chamber. Operation of the gerotor pump unit 55 results in positive movement of the fuel 6*a* from the tank 3 through the openings 58 and 58*a* into the gerotor pump unit 55. The fuel is discharged under pressure into and through the frame 51 and the motor cavity or housing to the outlet passageway 19 for delivery via the line 4 to the engine. The control unit 9 provides electrical power to the motor 17 in accordance with the sensed pressure in the fuel line as established by the pressure transducer 10.

The motor 17 should provide the torque necessary to operate the motor over a wide speed range, from a very low speed to maintain a recycle flow even at zero demand flow to a relatively high speed as the flow demand increases, and the pressure tends to decrease. Further, the motor current should be minimized at all speeds to prevent damaging or dangerous heating levels in the system. Thus, the pump-motor response should include a torque characteristic which establishes a rapid response to the changes in an increased flow demand over the desired operating range of the fuel supply operating curve, such as shown in FIG. 10, and operating without creating undesired heat within the operating environment. Generally, a typical system specification may require operation through a range of 0 to 25 gallons per hour at a system pressure of 40 PSI±2.5 PSI. For example, a conventional permanent magnet design has been used with the armature lengthened to produce the response characteristic of FIG. 10 in the illustrated embodiment.

Figure 3:
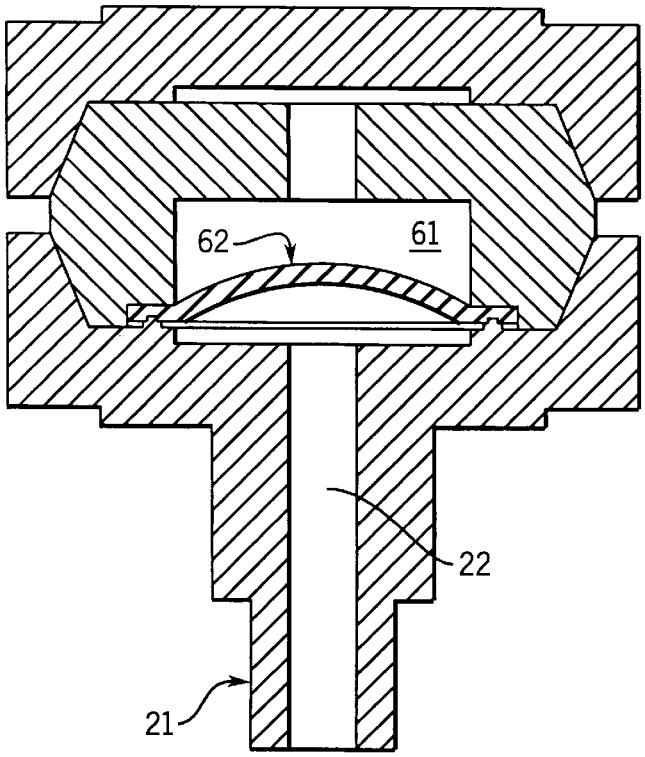
FIG. 3 is an enlarged view of a sensor unit shown is FIG. 7.

It is important to insure that the permanent magnet motor does not stall out. Thus, as the motor speed is reduced with decreasing flow demand, the efficiency of the motor decreases, and under a stalled condition may create an excessive heat source. The illustrated system serves to operate the motor at low speed preventing stalling and avoids excessive heating. As the speed demand increases, the "on" time is proportionally increased to produce the necessary torque while avoiding excessive heating as a result of the increased efficiency of the motor. Thus, this system avoids the necessary using of a large storage capacitor to provide power, as in the prior systems. The pressure transducer 10 thus includes an outer body housing 59 with the sensing port 22 projecting therefrom. As shown in FIGS. 3 and 7, the pressure transducer is thus preferably of a diaphragm-type construction with the sensing passageway 22 in port 21 separated from a signal chamber 61 by a suitable diaphragm 62, for operating a pressure responsive signal unit in the chamber 61. The transducer must be operable with the fuel supply applied to the diaphragm. The pressure transducer 10 may be formed, for example, by using a sensor manufactured by Motorola corporation and identified as a model MPX2700D which includes a silicon piezoresistive pressure sensor system. The transducer unit 10 is connected to the control circuit board 25 for and amplified with IC Amplifiers for controlling the power connection to the motor 17. In the illustration embodiment as presently developed, the motor control circuit provides an output such that the motor is pulse width modulated, typically as shown if FIG. 10, to establish and maintain the pressure in line 4 constant. The control unit 9, as disclosed in the illustrated embodiment, and particularly as shown in FIGS. 4–7*a*, is a sealed unit having an outer encircling housing wall 64, with a bottom wall 65 specially constructed to abut in fitted relation to the motor-pump shell 32. The wall 64 is a generally rectangular wall having an open top and an open bottom. The wall 64 extends over the motor-pump unit including the outer end frame 24, with the circuit board overlying the motor frame 36 and shell 32 and the pressure transducer 10 aligned with end frame 24. The open bottom of housing 64 has a curved end edge 66 aligned with the shell 32 and an offset curved end edge 67 aligned with the end frame 24. The bottom edge 66 is curved to match and abut the shell 32. The curved edge 67 is shaped generally to overly frame 24 extended outwardly of the shell 30. The side portion of edges 66 and 67 are joined by curved edge portions 68 aligned with the end 31 or shell 32 adjacent end frame 24. The bottom end of the housing wall 64 thus conforms essentially to the configuration of the shell, with the edge in abutting relation thereto. The offset curved end edge 67 is spaced slightly from the end frame 24 to define a small gap there between.

An aluminum plate 69 is secured within the bottom opening of housing wall 64 and abuts an inner flange 70, encircling the wall in upward spaced relation to the bottom edges 66 and 67. The flange 70 is spaced in accordance with the thickness of the plate 69. The plate 69 and flange 70 with the edges 66 and 67 define bottom wall 65 conforming to motor-pump unit 8. The plate 69 is thus secured in the assembled relation, in close abutment to the shell 32, except for the offset portion aligned with the frame 24. It is spaced from the surface of the end frame 24 to define a small gap 71 there between to allow circulation of the fuel within the tank via the passageway 23 and bypass passageway 46, as previously described.

Figure 5:
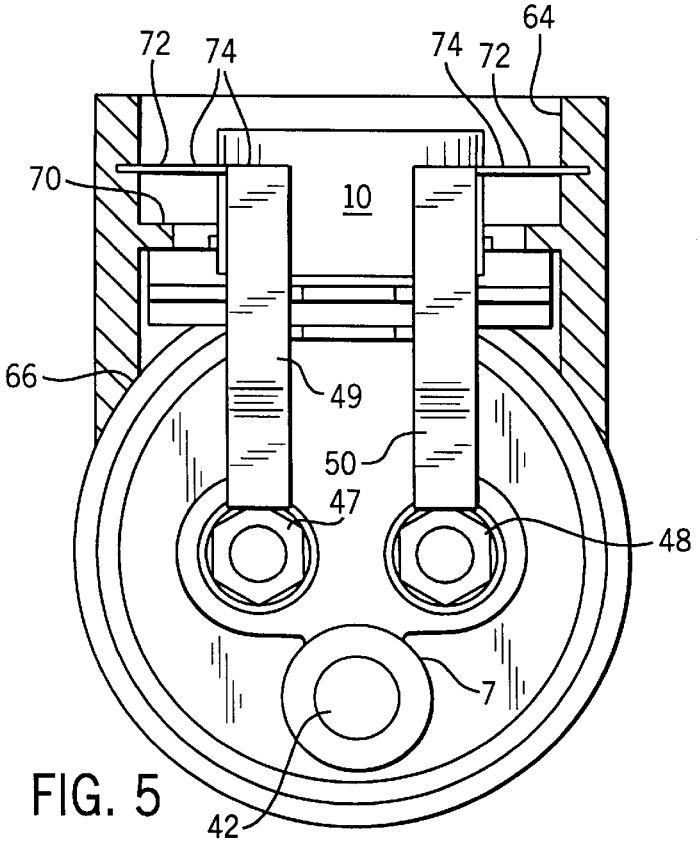
FIG. 5 is an end view of the unit shown in FIG. 4.
Figure 4:
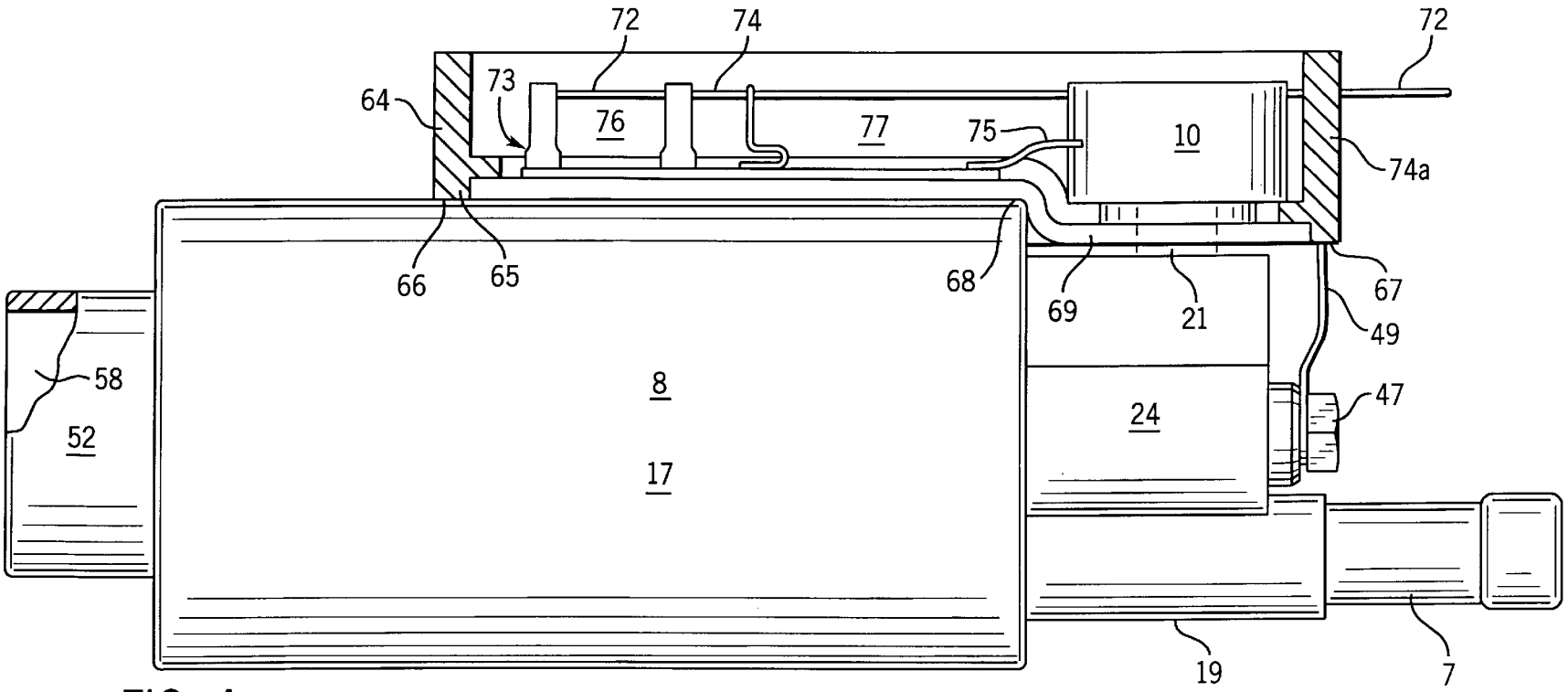
FIG. 4 is a side elevation view of the integrated fuel pump unit and integrated control unit shown in FIGS. 1–3.
Figure 6:
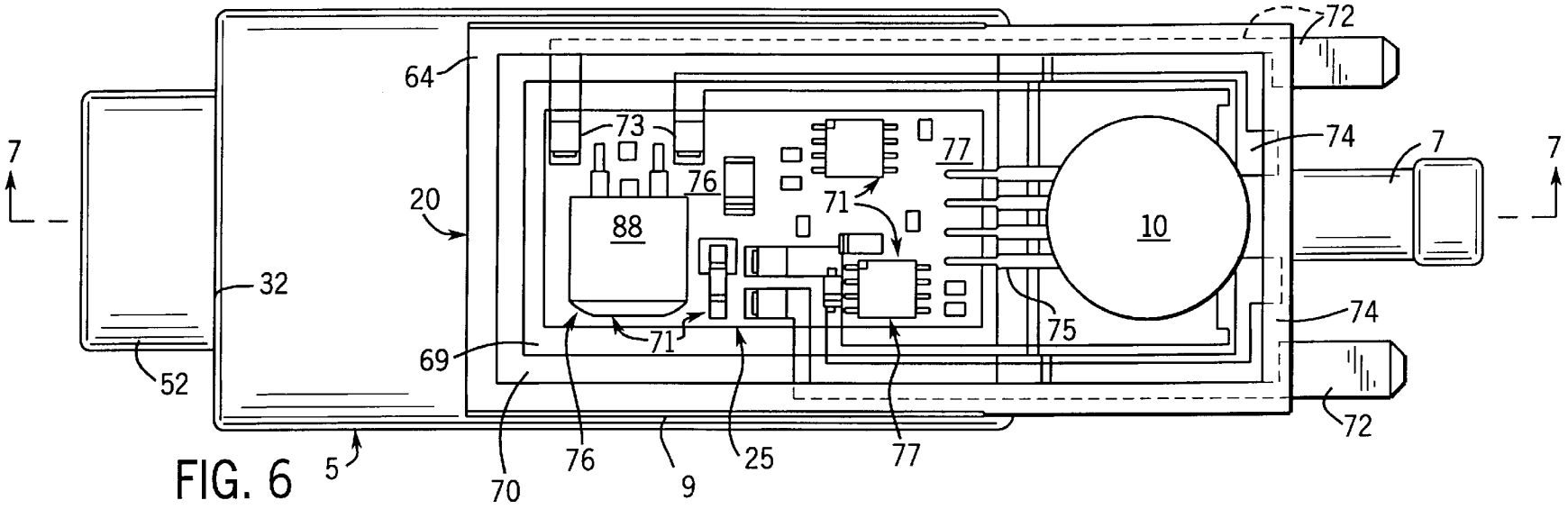
FIG. 6 is a top view of FIGS. 4 and 5, with parts broken away to show certain details of construction.

The encircling wall 64 and the plate 69 define an upward open housing 20, within which the transducer 10, circuit board 25 and the control circuitry is mounted. The control circuitry is mounted on the circuit board 25, which is preferably a ceramic board and is bonded to the aluminum plate 69. The circuit board 25 is secured within a flat top of the plate 69 which is in tight abutment to the shell 32 for optimum heat transfer from the heat sensitive components of the control unit. With reference to FIGS. 4–6, the circuit elements and connections are partially shown for purposes of clarity and illustration. The circuit and component mounting is more fully disclosed in FIG. 8, FIG. 9, and the description of a preferred control circuit.

Referring to FIGS. 4, 5, 6, 7, and 7*a*, incoming power supply terminal and lead 72 are secured within the side walls of the encircling housing wall 64. In the illustrated embodiment of the invention, each of the terminals 72 is an elongated conductive strip embedded in the side wall 64 and extending from and at the end wall adjacent the end frame 24 to form a spade type terminal. The conductive strips extend substantially throughout the side walls and are secured at the inner end to the circuit board 25 as at 73. The motor connecting leads 74*a* are embedded in the end wall 74 of the housing 64 between the power lead terminals 72. The motor connecting leads 74 are again conductive strip members secured to the circuit board 25 and protruding downward through the end wall 74*a* and therefrom as connectors 49 and 50 into connection to the motor terminals 47 and 48. In addition, the supply and output leads or terminals 75 of the pressure sensor transducer 10 project laterally from the transducer housing, and are interconnected to the circuit at board 25. As shown in FIGS. 4 and 6 and more fully developed hereinafter, the circuit board 25 is generally divided into a power section 76 with the incoming power leads and with the high temperature components secured to the ceramic board 25 within that section. A control section 77 is provided on the circuit board 25 between power section 76 and the transducer unit 10 and interconnected thereto through the transducer leads 75. The total system of circuit elements and the connectors are located below the upper level or edge of the wall 64. The chamber defined by the wall 64 and the bottom wall 65 is filled with a suitable potting material 78 to protect the circuitry and permit the immersion within the fuel tank 3.

Referring to FIG. 2, the control unit 9 is secured to the mounting plate 11 by an L-shaped mounting plate 79, having a first leg connected to plate 11 by a connector 79*a*. An encircling strap 80 extends from one edge of the plate about the fuel pump unit 8 and is secured to itself at the opposite edge of the plate by a releasable buckle 81. The depending leg 82 of the plate 79 has an opening which fits over the outer extension 52 of the end to the filter unit 12 by a connector 83. The assembly defines an integrated motor-pump and control assembly 5 adapted to be directly mounted within or without the fuel tank 3. In the illustrated embodiment of the invention with the in-tank mounting, the total assembly merely requires the connection from the internal connector 15 of FIG. 2 on the plate 11 to the power spade type terminals 72 for providing power to the control unit 9 and to the motor-pump unit 8. The strap unit 80–81 firmly attaches the control unit 9 in firm abutting engagement with the motor and provides for optimum transfer of heat from the circuit board 25 to maintain appropriate operation within the fuel tank. The control circuit usable with the system, may of course, take any one of a great number of different characteristics, including but not limited to systems heretofore disclosed in the prior art.

Figure 8:
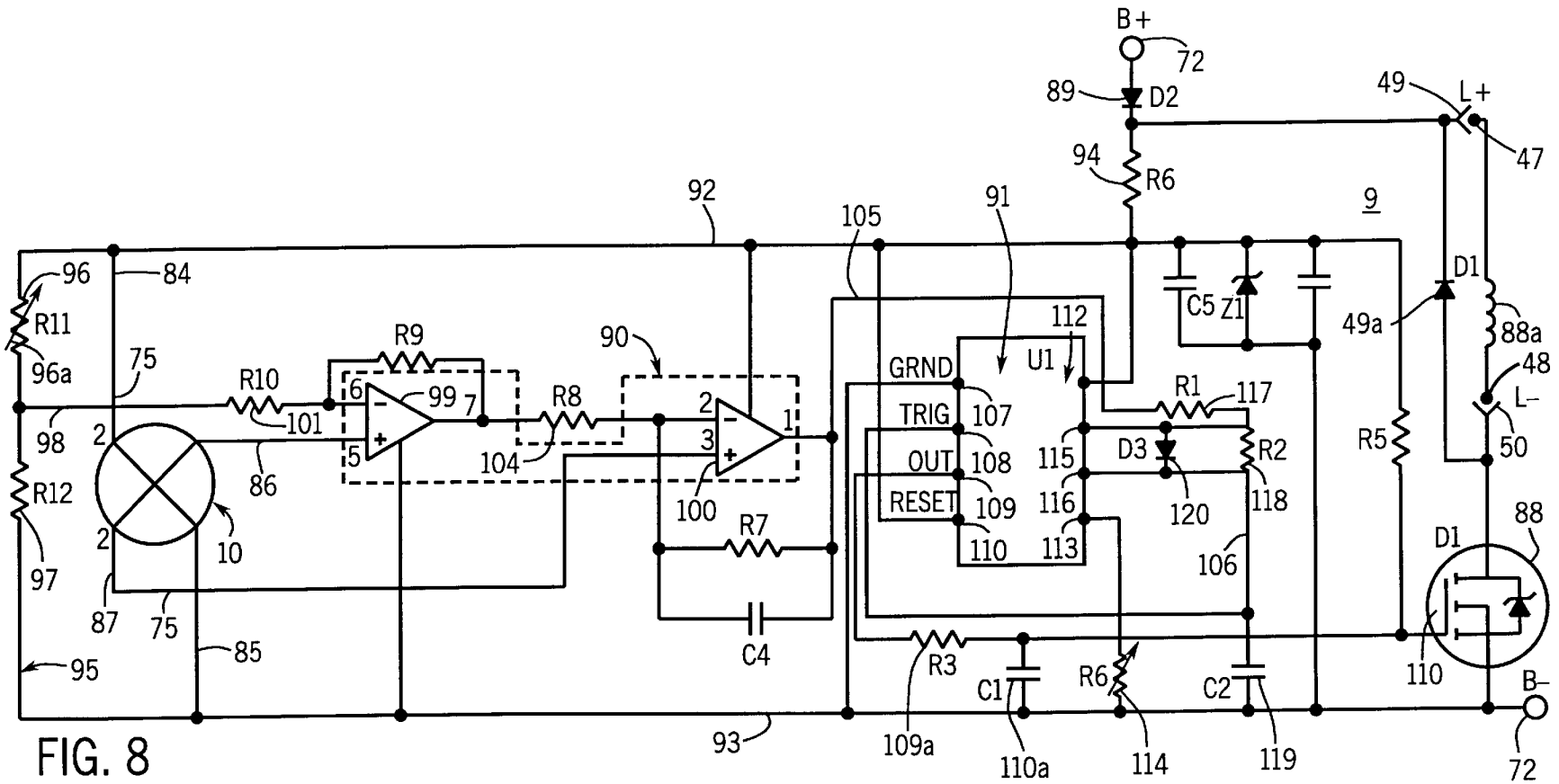
FIG. 8 is a schematic circuit diagram of a preferred control circuit for maintaining a constant supply pressure from the fuel pump unit of FIGS. 1–7.
Figure 9:
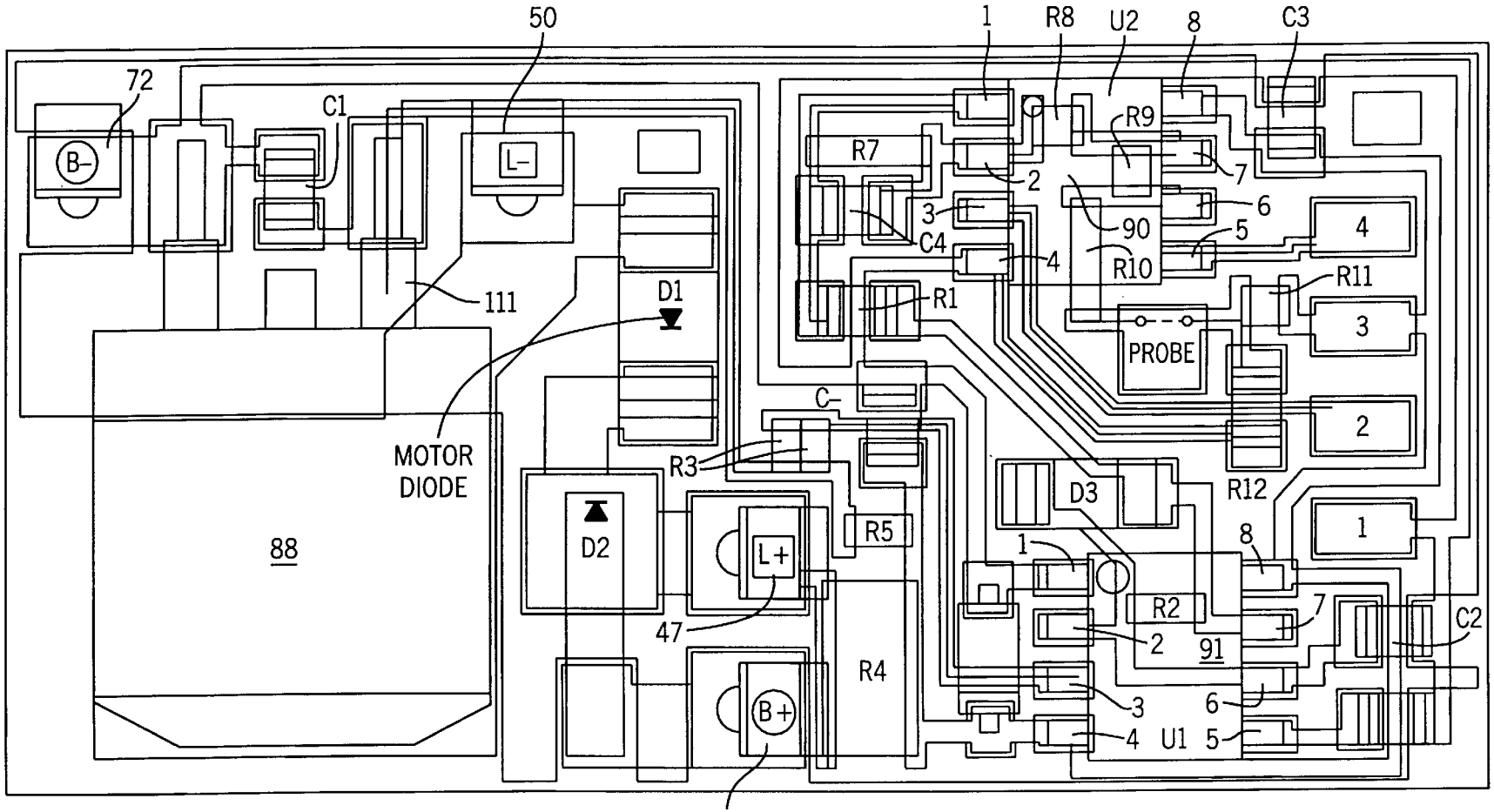
FIG. 9 is a circuit board layout for the circuit of FIG. 8.

In a further aspect of the present invention, a unique circuit provides full power to the motor, depending on whether the output pressure is at the set level or below. A preferred circuit embodying a control of this nature is disclosed in FIGS. 8 and 9. Referring particularly to FIG. 8, the circuit components and interconnections are shown in a schematic circuit diagram, with the pressure transducer 10 illustrated. The physical mounting of the components as shown in FIG. 8 on the circuit board 25 are shown in a preferred arrangement in FIG. 9. Referring to FIG. 8, the pressure transducer 10 is shown illustrated with the four interconnecting connectors or leads 75, including a pair of input leads 84 and 85, and a pair of output leads 86 and 87. The input power terminals 72 are connected to the power supply terminals of unit 15 of FIG. 2. The signal leads 86 to 87 from the pressure transducer unit 10 such as previously described are connected to the ends of the control circuit, as presently described. The control circuit includes a solid state switch 88, preferably a MOSFET transistor, connected between the common power terminal 48 and the motor connecting terminal 50. The motor 17 is shown including the motor winding 88*a* connected to terminal 50. The opposite side of the winding 88*a* is connected to the positive motor terminal 49. A diode 89 connects the terminal 49 to power supply terminal 72 and prevents reverse connection of the battery to the control circuit. A protective diode 49*a* is connected directly across the motor connecting members 49 and 50. Thus, whenever transistor 88 conducts, power is supplied to the DC motor 17 for operation of the motor-pump unit. The control circuit includes a dual stage amplifying chip 90 connected to sense the output of the pressure transducer 10 and provide an amplified output signal. A timing chip 91 is used to drive the MOSFET switch 88 and turn the switch off or on. The MOSFET transistor 88 is a well-known voltage responsive device having an essentially instantaneous response as a result of its voltage characteristic. The offset voltage branch 95 includes an adjustable resistor 96, illustrated by the adjustment arrow 96*a*, and a fixed resistor 97 connected in series. A reference line 98 connects the junction of the resistors to the input of the amplifier chip 90. The chip includes a first amplifier 99 and a second amplifier 100, illustrated as typical operational amplifiers. The negative input of amplifier 99 is connected to the offset voltage branch at the junction of resistors 96 and 97. The output lines 86 and 87 of the transducer 10 are connected to the positive input of amplifiers 99 and 100 to provide an amplified voltage output proportional to the output of the pressure transducer. In particular, a resistor 101, connects the junction of resistor 96 and 97 to the negative input of amplifier 99. The output of amplifier 99 is connected by resistor 104 to negative input of amplifier 100. The output of amplifier 100 is connected by line 105 to the RC timing network of timer chip 91 to determine the pulse width modulated frequency. The timer chip 91 includes a monolithic circuit which uses an external RC network to control the output frequency. As shown, the circuit is connected in an astable circuit connection such as shown in the Motorola handbook of 1988 chapter 11, page 11-4. More particularly, the chip includes a ground terminal 107 connected directly to the common or B− line 93. A trigger input terminal 108 connected to the RC timing network 106, as hereinafter described, and an output terminal 109 is connected to resistor 109*a* which controls MOSFET 88 gate 110. A capacitor 110*a* connects the gate 110 to the common line 93. A power supply line terminal 112 is connected to the B+ line 92. A control input terminal 113 is connected to the negative supply line 93 in series with an adjustable resistor 114, illustrated by the adjustable arrow. A pair of response terminals 115 and 116 are connected to the branch circuit 106 and establish operation of the timing circuit in accordance with the pressure related amplified signal from the amplifying chip 90. The branch circuit 106, connected to line 105 to receive the amplified signal, includes a series circuit, including resistor 117 and a capacitor 119 connected between line 105 and the B− line 93. The terminals 115 and 116 are connected respectively to the opposite sides of the resistor 118.

The timing circuit of chip 91 operates in a known astable circuit and is more fully disclosed in the Motorola handbook, to provide a drive signal output at terminal 109 and thereby to the gate 110 of MOSFET 88. The amplified transducer voltage at 105 is used to charge capacitor 119 through resistor 117 and diode 120. This charge circuit path determines the high or "on" period of output pulse width at terminal 109. Capacitor 119 must charge to the control voltage value set by adjustable resistor 114 before a timing cycle begins. When capacitor voltage 119 reaches the control voltage value set by resistor 114 timing chip 91 resets a flip-flop within the Monolithic circuit, which changes the output at terminal 109 to from a high to low voltage thereby turning off MOSFET 88 and motor 17, and switches on a discharge transistor within the Monolithic circuit of timer chip 91. Capacitor 119 then discharges through resistor 118 and the discharge transistor inside timer chip 91 which determines the low "off" output pulse width at terminal 109. With the transducer voltage signal equal to or less than that related to the desired pressure as shown in FIG. 10, full voltage is applied to the motor. If the pressure rises above such pressure level, the amplified signal charges capacitor 119. The time required to charge capacitor 119 is directly proportional to the applied voltage at line 105. Thus at higher pressures the capacitor 119 charges faster resulting in shorter high output pulse widths. The low output pulse width is always a fixed value. The illustrated embodiment has been constructed to operate over a wide range of pressures and flows, and in at least one embodiment at 40 pounds per square inch (PSI). As shown if FIG. 10, the system operates with a substantial straight line over a significant flow range, with increasing pressure drop at about 25 gallons per hour. This produces a particularly satisfactory system for automobiles and other similar vehicles.

A preferred layout of the circuit components is illustrated in FIG. 6, with the power transistor 88, the main supply power connections 73, and the motor output power connections shown in the power section 76 of the ceramic board 25. The balance of the circuit system, including the control circuit components, are generally shown in the control section 77, or right half of the ceramic plate 25. The circuit components are mounted and interconnected through a surface mounting technique generally, for example as fully disclosed in the U.S. Pat. No. 4,775,917, issued Oct. 4, 1988 and assigned to Wells Mfg. Co. The separation of the power section 76 and the control section 77 permits optimum coupling of the control unit 9 to the motor unit 8 with transfer of heat to the control circuitry and the components minimized. A typical and satisfactory component listing is as follows. No description thereof is given in view of the corresponding numbering of the elements in the drawings in FIGS. 8 and 9.

The motor pump-unit, and the control circuit unit may be formed as separate components within the teaching of the present invention, and each component may be connected to another component of a different construction. Further, the integrated assembly or separate component assemblies may be mounted externally of the fuel tank.

The by-pass system built into the motor-pump system is significant to maintain a continuous pumping system which is not subject to vapor lock and which can rapidly respond to demand for fuel. Although shown incorporated into the motor structural elements as such, a by-pass line system may be coupled to the output line within the broadest aspect of this invention. Thus, a separate line may connect the high point of the pump output to the fuel supply. In a separate mount system, the pump unit may be mounted adjacent the tank, with a direct recycle line or in a return line system the pump unit can be connected to maintain the flow therethrough.

Various modes of carrying out the invention are contemplated as being within the scope of the following claims particularly pointing out and distinctly claiming the subject matter which is regarded as the invention.

I claim:

1. A motor driven fuel system including a supply line and a fuel source for supplying fuel under pressure to an internal combustion engine, comprising a sensing apparatus to sense the pressure of the fuel flow to said engine, and a control unit operating said fuel source at a selected constant power input with the pressure at or below a first selected level and operating said fuel source with at least a selected lesser power input including a constant minimum power input with the pressure at or above a second selected level and operating said fuel source with a varying power input with the pressure between said first and second selected levels.

2. The motor driven fuel supply system of claim 1 wherein said fuel source includes a motor driven pump unit, said sensing apparatus including a transducer coupled to the output of the motor driven pump unit and establishing an output control signal related to said pressure, and said control unit including a switching means for changing the operation of said fuel source between said selected constant power input and said selected minimum power input in accordance with said control signal.

3. The motor driven fuel system of claim 1 wherein said fuel source comprises a motor driven pump unit having a motor with a tubular frame, said frame having a first end and a second end, a pump connected to said first end to establish flow into said tubular frame, an outlet unit secured to said second end, a connecting unit configured to connect the outlet unit to the supply line, an electrical power supply for operating of said motor, said control unit including a sealed housing and a switch unit within said housing, said switch unit connecting said power supply to said motor, said control unit including a pressure transducer within said housing and coupled to said outlet unit of said motor to establish an output signal related to the output pressure of said motor driven pump unit, and a control circuit within said housing connected to said output signal of said transducer and to said switch unit for placing said switch unit in a fixed position with the pressure at or below a selected level and placing said switch unit in a second position with the pressure above said second selected level.

4. The motor driven fuel supply system of claim 3 wherein said housing includes a bottom wall conforming to said tubular frame, said bottom wall including a heat exchange plate, said control unit includes a circuit board secured to said heat exchange plate, an attachment structure connected to said motor and to said housing and securing said housing with said heat transfer plate abutting said tubular frame of said motor and forming an integrated motor and pump assembly configured for in-tank mounting and said fuel being pumped through said motor to said supply line, whereby said motor and said control unit are cooled by continuous flow of said fuel to said engine.

5. The motor driven supply unit of claim 4 wherein said control circuit includes a power section including a solid state switch unit and interconnecting incoming power supply connections connected to said switch unit and motor output supply connections connected to said motor, said control circuit further including an integrated amplifying circuit and an integrated signal timing circuit interconnected to each other and to said solid state switch for turning said solid state switch on and off, said solid state switch and said power supply connections being connected to and mounted on one portion of said circuit board and said integrated amplifying circuit and said integrated signal timing circuit mounted on an adjacent portion of said circuit board.

6. A motor driven fuel supply system comprising a motor-pump unit including a motor and a pump connected to an inlet end of said motor and said motor having an outlet end establishing a pressurized output, an outlet passageway unit connected to said outlet end, a control unit secured in abutting relation to the said motor, said control unit having a sealed housing with a high heat transfer wall secured in tight abutting engagement with said motor for optimum heat transfer, said control unit including a pressure transducer aligned with said outlet end of said motor, said motor having an outlet end frame having a sensing passageway coupled to said outlet end and providing an input signal to said pressure transducer, said pressure transducer having a housing secured within said control unit and having a sensing member extending outwardly therefrom into said sensing passageway, said control unit having a mounting member secured to said housing and having a power input unit connected to said mounting member for supplying of power to said control unit, said control unit having a motor power terminal unit for supplying power from within said control unit to said motor, said control unit including a electronic circuit means connected to said pressure transducer and to said motor power terminal unit for providing said power to said motor in accordance with the output of said pressure transducer, said control circuit having a power section and a control section interconnected to each other and to said pressure transducer and to said power terminal unit, said control section being mounted to a supporting base and said base wall secured in tight abutment to said heat transfer wall.

7. The apparatus of claim 6 wherein said control unit provides essentially full output voltage drive to said motor in response to a pressure at or below a selected desired pressure, and a pulse width modulated voltage to slow down or speed up said motor to supply fuel as demanded and maintain pressure in response to a pressure above or at said selected desired level.

8. The apparatus of claim 7 wherein said control unit includes a MOSFET transistor connected in series with said motor power terminal unit for supplying of said full output voltage or said pulse width modulated voltage to said motor.

9. A control circuit for energizing of a motor pump unit establishing and maintaining fuel flow therefrom at a selected output pressure range, comprising a pressure transducer having an input configured for servicing the fuel flow from the motor pump unit and operable to establish an electrical pressure related signal proportional to the fuel pressure from said motor pump unit, an amplifying circuit for receiving of said pressure related signal and establishing an output control voltage related thereto, a timing circuit adapted to establish an essentially constant output voltage in response to a first voltage input signal and an essentially minimal output voltage in response to a second input voltage signal, said timing circuit having an input connected to said output of said amplifying circuit for establishing an output related to said output control voltage, said timing circuit including a rapid acting solid state switch connected in an output circuit with said motor and operable to establish a continuous constant voltage level to said motor with said pressure at or below said selected pressure and a pulse width modulated voltage to said motor with said pressure above said selected level.

10. The circuit of claim 9 wherein said amplifying circuit includes an integrated dual amplifier chip including an input amplifier connected to receive the signal from said pressure transducer and establishing an amplified output signal to said second amplifier, said second amplifier connected to said switch.

11. The circuit of claim 9 wherein said timing circuit is an integrated timing chip having a low frequency output establishing a pulse width modulated output voltage to said switch, said pulse width modulated output voltage including a minimum voltage level of a constant width and a constant high voltage level of a variable width.

12. A motor-driven fuel supply apparatus for an internal combustion engine, comprising a fuel pump unit having an output line, a motor connected to operate said fuel pump and establishing a pressurized fuel flow in said output line, a pressure transducer providing an output voltage signal related to the output pressure of said pump unit, an amplifier for amplifying of said voltage signal from said transducer, a control circuit having an output connected to said motor and a timing circuit having an input connected to said amplified voltage signal and operating to maintain an essentially constant output power to said motor with said pressure transducer establishing a voltage signal in accordance with a pressure equal to or less than a first selected output pressure in said output line and reducing said output power including a constant reduced output power for a second selected pressure above said first selected output pressure.

13. The fuel supply apparatus of claim 12 wherein said transducer includes a diaphragm subjected to the output pressure of the pump unit and includes a pressure responsive element establishing said voltage signal.

14. The fuel supply apparatus of claim 12 wherein said timing circuit is an astable timing circuit having a voltage responsive input.

15. The fuel supply apparatus of claim 12 wherein said timing circuit includes an integrated timing chip having said input responsive to said voltage signal and having an output controlled by the voltage signal at said input, a control capacitor, a first resistor connecting the output of said amplifier to said capacitor for charging said capacitor, a second resistor connecting said capacitor to said input, said timing chip operating in an astable timing mode and establishing a pulsed output with the width of the pulse output related to the level of the charge on said capacitor, said output being connected to a rapid-acting solid state switch for turning on said switch and establishing said essentially constant output power to said motor pump unit and establishing an essentially constant off period to establish and maintain a selected pressure and flow from the motor driven pump unit.

16. The fuel supply apparatus of claim 15 wherein said timing chip includes a circuit control input, and an adjustable resistor connected to said circuit control input to establish the start of a timing cycle.

17. The fuel supply apparatus of claim 15 including a control housing including a bottom wall structure of a high heat transfer characteristic, a control circuit board secured in abutting relation to said bottom wall, said amplifying circuit and said timing circuit being secured to said circuit board, said pressure transducer being secured within said housing, power input terminals extended from said housing and connected to said circuit board and output motor terminals extended from said housing and connected to said circuit board within said housing, said transducer having an input port extended from said housing and adapted to be connected to the output of said pump unit for sensing the output pressure, said housing being filled with an encapsulating material to seal the unit against entrance of fluids and thereby permit in-tank mounting of said control circuit unit within a fuel tank and adapted thereby to be connected in sealed relation to said pump unit and mounted within said tank unit.

18. The fuel supply apparatus of claim 17 wherein said control housing is secured in firm heat transfer abutment to the exterior wall of said motor-pump unit.

19. The control circuit of claim 18 wherein said motor-pump unit includes a restricted output connected for recirculation of fluid continuously within the fuel tank.

20. The fuel supply apparatus of claim 12 wherein said motor is a permanent magnet motor having an outer cylindrical housing and including a first end frame having a fuel inlet passageway and a second end frame including a fuel outlet passageway with the fuel flow through said housing between said passageways, a gerotor pump unit secured between said first end frame and said housing for establishing said fuel flow through said housing.

21. The fuel supply apparatus of claim 20 including a control housing having a bottom wall conforming to the exterior of said cylindrical housing, said timing circuit including a circuit board secured to said bottom wall within said housing and establishing heat transfer through said bottom wall to said housing, and said housing being sealed for in-tank mounting of said integrated motor-pump assembly and said control housing.

22. The fuel supply apparatus of claim 20 wherein a small circulating passageway is connected to said outlet passageway to maintain fuel flow under all operating conditions.

23. The fuel supply apparatus of claim 22 wherein said circulating passageway is formed in said second end frame, and an in-tank mounting unit locating said motor with said circulating passageway at the exit position with respect to said motor and pump unit.

24. The fuel supply apparatus of claim 21 wherein said control housing has an end portion overlying said second end frame and said end portion of said control housing spaced slightly outwardly of said second end frame, said second end frame has a pressure sensing passageway terminating in an outlet opening, said transducer being mounted in said second end frame and includes an inlet port secured within said outlet opening of said pressure sensing passageway, and a small recirculating passageway in said second end frame connecting said sensing passageway directly to the space between said control housing and said second end frame.

25. A method for maintaining a fuel supply at a substantially constant pressure to an internal combustion engine with a motor pump unit having the capability of establishing a minimum selected fuel pressure with a selected voltage applied to said motor, comprising sensing said fuel pressure and establishing a control signal related thereto, comparing said sensed signal with a reference signal corresponding to said substantially constant pressure, supplying full power to said motor pump unit with said control signal at or below said minimum selected pressure level and supplying a pulse width modulated voltage to said motor when said sensed fuel pressure is at or above said minimum selected pressure level and thereby maintaining said substantially constant fuel supply pressure to said engine.

26. A method for maintaining a fuel supply at a substantially constant pressure to an internal combustion engine with a motor pump unit having the capability of establishing a minimum selected fuel pressure with a selected voltage applied to said motor, comprising sensing said fuel pressure and continuously supplying a constant input power to said motor pump unit with the fuel pressure at or below said selected fuel pressure, and pulse width modulating said power supplied to said motor pump with a fixed "off" period and a variable "on" period to maintain the substantially constant pressure and flow from the unit with said fuel pressure above said minimum selected fuel pressure.

* * * * *